US009140261B2

(12) United States Patent
Huang et al.

(10) Patent No.: US 9,140,261 B2
(45) **Date of Patent: *Sep. 22, 2015**

(54) SHUNT PULSATION TRAP FOR CYCLIC POSITIVE DISPLACEMENT (PD) COMPRESSORS

(75) Inventors: Paul Xiubao Huang, Fayetteville, GA (US); Sean Wiliam Yonkers, Peachtree City, GA (US)

(73) Assignee: HI-BAR BLOWERS, INC., Fayetteville, GA (US)

( * ) Notice: Subject to any disclaimer, the term of this patent is extended or adjusted under 35 U.S.C. 154(b) by 448 days.

This patent is subject to a terminal disclaimer.

(21) Appl. No.: 13/404,022

(22) Filed: Feb. 24, 2012

(65) Prior Publication Data

US 2012/0237378 A1 Sep. 20, 2012

Related U.S. Application Data

(60) Provisional application No. 61/452,160, filed on Mar. 14, 2011.

(51) Int. Cl.
*F04C 29/06* (2006.01)
*F04B 11/00* (2006.01)
(Continued)

(52) U.S. Cl.
CPC ..... *F04C 29/061* (2013.01); *F04B 11/00* (2013.01); *F04B 11/0033* (2013.01); *F04B 39/0027* (2013.01); *F04B 39/0088* (2013.01); *F04C 29/0035* (2013.01); *F04C 29/065* (2013.01)

(58) Field of Classification Search
CPC .. F04C 29/061; F04C 29/003; F04B 11/0033; F04B 39/0027; F04B 39/0088; F04B 11/00
USPC ..... 417/540, 312
See application file for complete search history.

(56) References Cited

U.S. PATENT DOCUMENTS 2,489,887 A 11/1949 Houghton
4,215,977 A * 8/1980 Weatherston ..... 418/1
(Continued)

FOREIGN PATENT DOCUMENTS

JP 60252117 12/1985
JP 01032085 2/1989
(Continued)

OTHER PUBLICATIONS

Raw Machine translation of Japanese Publication JP 07-332273 A, Tomita Koji, Dec. 1995, "Casing structure for compressor".*

*Primary Examiner* — Charles Freay
*Assistant Examiner* — Lilya Pekarskaya
(74) *Attorney, Agent, or Firm* — Gardner Groff Greenwald & Villanueva, P.C.

(57) ABSTRACT

A shunt pulsation trap for a cyclic positive displacement (PD) compressor reduces gas pulsation and NVH, and improves off-design efficiency, without using a traditional serial pulsation dampener and a variable geometry. A shunt pulsation trap for a cyclic PD compressor is configured to trap and attenuate gas pulsations before discharge and includes a housing having a flow suction port, a flow discharge port, a compressor cavity, and a pulsation trap chamber adjacent to the PD compressor cavity. The pulsation trap chamber includes at least one pulsation dampening device, at least one injection port (trap inlet) branching off from the PD compressor cavity into the pulsation trap chamber and a feedback region (trap outlet) communicating with the PD compressor outlet. The associated methods of reducing pulsations are included as another aspect of the invention.

20 Claims, 13 Drawing Sheets

(5a). Absorptive Dampening (5b). Reactive Dampening

(51) Int. Cl.
*F04B 39/00* (2006.01)
*F04C 29/00* (2006.01)

(56) References Cited

U.S. PATENT DOCUMENTS

| | | | | |
|---|---|---|---|---|
| 4,558,566 | A | 12/1985 | Shirakura | |
| 4,984,974 | A | 1/1991 | Naya et al. | |
| 5,051,077 | A * | 9/1991 | Yanagisawa et al. | 418/201.1 |
| 5,217,817 | A | 6/1993 | Verspui et al. | |
| 5,218,817 | A | 6/1993 | Urata | |
| 5,370,512 | A | 12/1994 | Fujitani et al. | |
| 5,975,035 | A | 11/1999 | McWhorter | |
| 6,331,103 | B1 * | 12/2001 | Teraoka | 418/181 |
| 6,874,486 | B2 | 4/2005 | Prior et al. | |
| 8,172,039 | B2 | 5/2012 | Park et al. | |
| 2002/0033302 | A1 | 3/2002 | Kaneko et al. | |
| 2006/0243520 | A1 | 11/2006 | Hertenstein et al. | |
| 2008/0168961 | A1 | 7/2008 | Prior et al. | |
| 2010/0269797 | A1 | 10/2010 | Prior | |
| 2011/0300014 | A1 | 12/2011 | Huang et al. | |
| 2012/0020824 | A1 | 1/2012 | Huang et al. | |
| 2012/0171069 | A1 | 7/2012 | Huang et al. | |
| 2013/0247849 | A1 | 9/2013 | Huang et al. | |

FOREIGN PATENT DOCUMENTS

| | | | | |
|---|---|---|---|---|
| JP | 03124986 | | 5/1991 | |
| JP | 07-332273 | A * | 12/1995 | F04C 18/16 |
| JP | 07332273 | | 12/1995 | |

* cited by examiner (3c). Under-Compression (3d). Over-Compression (4d). Under-Compression (4e). Over-Compression (5a). Absorptive Dampening (5b). Reactive Dampening

SHUNT PULSATION TRAP FOR CYCLIC POSITIVE DISPLACEMENT (PD) COMPRESSORS

CLAIM OF PRIORITY

This application claims priority to Provisional U.S. patent application entitled A SHUNT PULSATION TRAP FOR CYCLIC POSITIVE DISPLACEMENT (PD) COMPRESSORS, filed Mar. 14, 2011, having application No. 61/452,160, the disclosure of which is hereby incorporated by reference in its entirety.

BACKGROUND OF THE INVENTION

1. Field of the Invention

The present invention relates generally to the field of positive displacement (PD) type blowers, compressors, and more specifically relates to a shunt pulsation trap for reducing gas pulsations and vibration, noise and harshness (NVH) and improving compressor off-design efficiency without using a traditional serial pulsation dampener or a sliding valve.

2. Description of the Prior Art

PD compressors are capable of generating high pressures for a wide range of flows and are widely used in various applications, for examples, as in pipeline transport of purified natural gas from the production site to consumers thousands of miles away; or in petroleum refineries, natural gas processing plants, petrochemical plants, and similar large industrial plants for compressing intermediate and end product gases; or in refrigeration and air conditioner equipment to move heat from one place to another in refrigerant cycles; or in many various industrial, manufacturing processes to power all types of pneumatic tools, etc.

A positive displacement compressor converts shaft energy into velocity and pressure of a gas media (in a broader sense it includes different gases or liquid and gas mixture) by trapping a fixed amount of gas into a cavity then compressing that cavity and discharging into the outlet pipe. A positive displacement compressor can be further classified according to the mechanism used to move the gas as rotary type, such as screw or scroll, and reciprocating type, for example like piston or diaphragm, as shown in FIG. 2*a*. Though each type of PD compressor has its own unique shape, movements, principle and pros and cons, they all have in common a suction port, a volume changing cavity and a discharge port where a valve controls the timing of the release of gas media. Moreover, they are all cyclic in nature and possess the same process cycle for the processed gas, that is, suction, compression and discharge. FIG. 3*a*-3*b* show the compression cycle of a conventional positive displacement compressor and FIG. 3*c* shows the generic structure of a cavity and discharge port connected to a serial outlet dampener. Gas flows into the compressor as the cavity on the suction side expands and traps the media that is then being compressed by a drive device (say a reciprocating piston or rotary lobe) as the trapped cavity volume is reduced. After a desired compression ratio or volume reduction ratio is reached, the discharge valve or porting is opened and gas flows out of the discharge into the outlet. The inlet volume is constant given each cycle of operation and discharge volume varies according to the compression ratio as designed. In a dry running positive displacement compressor, gas is compressed as dry media, while in an oil-flooded positive displacement compressor, lubricating oil is injected into the cavity that helps to lubricate and seal the gap and cool the gas at the same time.

Since PD compressor divides the incoming gas mechanically into parcels of cavity size for delivery to the discharge, it inherently generates pulsations with cavity passing frequency at discharge, and the pulsation amplitudes are especially significant under high operating pressures or off-design conditions of either under-compression or over-compression. An under-compression happens when the pressure at the discharge opening (system back pressure) is greater than the pressure of the compressed gas within the cavity just before the opening. This results in a rapid backflow of the gas into the cavity, a pulsed flow, according to the conventional theory. All fixed pressure ratio compressors suffer from under-compression due to varying system pressures. An extreme case is the Roots type blower where there is no internal compression at all, or under-compression is 100% so that pulsation constantly exists and pulsation magnitude is directly proportional to pressure rise from blower inlet to outlet. On the other hand, an over-compression takes place when pressure at discharge opening is smaller than pressure of inside the cavity, causing a rapid forward flow of the gas into the discharge. For most applications where the system back pressure is normally not a constant, a fixed pressure ratio PD compressor will result in either an under-compression or over-compression. This pressure difference is responsible for generating large amplitude pulsations that is common for all types of PD compressors. The gas pulsations generated by discharge pressure difference are generally within the gas discharge flow (called gas borne) and periodic in nature. They travel throughout the downstream piping system and if left uncontrolled, could potentially damage pipe lines and equipments, and excite severe vibrations and noises.

To control pulsations, a large dampener, usually in the form of sudden area change plenums consisting of a number of chokes and volumes, is required at the discharge and connected in series with the discharge port. It is fairly effective in pulsation control with a reduction of 20-40 dB, but it itself is large in size which creates other problems like inducing more noises due to additional vibrating surfaces, or sometimes induces dampener structure fatigue failures that could result in catastrophic damages to downstream components and equipments. At the same time, discharge dampeners used today create high pressure losses that contribute to poor compressor overall efficiency. Moreover, at the off-design conditions, say either an under-compression or an over-compression, compressor efficiency suffers more. The traditional method is to use a variable geometry design so that internal volume ratio or compression ratio can be adjusted to meet different system pressure requirements. These systems typically are very complicated structurally with high cost and low reliability. For this reason, PD compressors are often cited unfavorably with high pulsations, high NVH and low off-design efficiency when compared with dynamic types like the centrifugal compressor. At the same time, the ever stringent NVH regulations from the government and growing public awareness of the comfort level in residential and office applications have given rise to the urgent need for quieter and more efficient PD compressors.

The present invention is trying to meet these environmental protection and market needs to tackle the problem by a new approach by postulating a new pulsation theory that a combination of large amplitude waves and induced flow are the primary cause of gas-borne pulsations. The new theory is based on a well studied physical phenomenon as occurs in a shock tube (invented in 1899) where a diaphragm separating a region of high-pressure gas from a region of low-pressure gas inside a closed tube. As shown in FIG. 1*a*-1*b*, when the diaphragm is suddenly broken, a series of expansion waves is generated propagating from low-pressure to high-pressure region at the speed of sound, and simultaneously a series of pressure waves which can quickly coalesces (fully developed) into a shockwave is propagating from high-pressure to low-pressure region at a speed faster than the speed of sound, inducing rapid fluid flow behind the wave front at the same time. An interface, also referred to the contact surface that separates low and high pressure gases, follows at the same fluid velocity after the pressure or shock wave. By analogy, the sudden opening of the diaphragm separating high and low pressure is just like the sudden opening of compression cell to discharge gas at off-design conditions.

To understand the pulsation generation mechanism in light of the shock tube theory, let's review a cycle of a classical positive displacement compressor as illustrated in FIG. 3*a*-3*d* by following one flow cavity. Low pressure gas first enters the cavity formed by a casing and a drive device at compressor inlet as in the Suction Phase. Then the cavity is closed to the inlet and the trapped gas is being compressed as the drive device forces the trapped volume to decrease in the Compression Phase. When a desired compression ratio is reached, the cavity is suddenly opened to the outlet and discharged. A serially connected discharge dampener is there to attenuate pulsations generated in gas stream.

If the cavity pressure is less than the outlet pressure as in case of an under-compression, a backflow would rush into the cavity to equalize pressure inside as soon as the cavity is opened to the discharge, according to the conventional theory. Since it is almost instantaneous and there is no volume change taking place inside the cavity, the compression is regarded as a constant volume process, or iso-choric. However, according to the shock tube theory, the cavity opening phase as shown in FIG. 3C resembling the diaphragm bursting of a shock tube as shown in FIG. 1*b* would generate a series of pressure waves or a shock wave into the cavity. The pressure or shock wave front sweeps through the low pressure gas inside the cavity and compresses it at a speed faster than the speed of sound as in case of the under-compression. For the case of over-compression, a fan of expansion waves would sweep through the high pressure gas inside the cavity and expand it at the same time at the speed of sound. This results in an almost instantaneous adiabatic wave compression or expansion well before the induced flow interface (backflow as in conventional theory) could arrive because wave travels much faster than the fluid. In this view, the waves are the primary driver for pressure equalization process for conditions of either under-compression or over-compression while the pulsating flow movement is simply the induced flow behind the pressure waves.

In view of the new theory to explain the pulsation generation in case of an under-compression, as the pressure or shockwave travels to low pressure cavity as shown in FIG. 3*c*, a simultaneously generated expansion wave front travels in the opposite direction causing rapid pressure reduction and inducing backflow down-stream. While for the case of an over-compression, as the expansion wave travels to high pressure cavity as shown in FIG. 3*d*, a simultaneously generated pressure or shock wave front travels in the opposite direction causing rapid pressure increase and inducing forward flow down-stream. This pressure wave front travelling downstream at a speed faster than the speed of sound and inducing a fast flow behind it is the dominant source of gas-borne pulsations for a positive displacement compressor. Any effective pulsation control should target this high speed large amplitude mixture of waves and induced flow while minimizing the main flow losses at the same time.

Since the amplitude of industrial gas pulsations is typically much higher than the upper limit of 140 dB of the classical theory of Acoustics, the small disturbance assumption and linearized wave equation cannot be used reliably anymore. Instead, the following rules based on the above discussed Shock Tube theory can be used in interim to determine the source of gas pulsation generation and to quantitatively predict its amplitude and travel directions. In principle, these rules are applicable to gas pulsations generated by any positive displacement fluid machines such as engines, expanders, or pressure compressors and vacuum pumps.

1. Rule I: For two closed compartments (either moving or stationery) with different gas pressure $p_3$ and $p_1$ (FIG. 1*a*), there will be no gas pulsation generated if the two compartments are kept separate;

2. Rule II: If the divider between high pressure $p_3$ and low pressure $p_1$ is suddenly removed, it will trigger gas pulsation generation at the opening as a mixture of large amplitude Pressure Waves (PW) or shock wave*, Expansion Waves (EW)* and an Induced Fluid. Flow (IFF)* with magnitudes as follows:

*It can be demonstrated by Shock Tube theory that pressure waves and expansion waves have about the same pressure ratio, if both media are the same gas type $(P_2/P_1)==(P_3/P_1)^{1/2}$, see Reference: Anderson, J., 1982, "Modern Compressible Flow", McGraw-Hill Book Company. New York $$PW=p_2-p_1 \tag{1}$$

$$EW=p_3-p_2 \tag{2}$$

$$\Delta U=(p_2-p_1)/(d_1\times W) \tag{3}$$

where $d_1$ is the gas density, W the speed of shock wave travelling into the low pressure region and $$p_2=(p_3\times p_1)^{1/2} \tag{4}$$

3. Rule III: the generated Pressure Waves (PW) or shock wave travel at the speed of shock wave W low pressure region while Expansion Waves (EW) move at the speed of sound in the direction opposite to PW, while at the same time both waves induce an unidirectional fluid flow (IFF) moving in the same direction as the pressure waves (PW).

Pay attention to Rules II which gives the location of gas pulsation source as the place of sudden opening between $p_3$ and $p_1$. It also indicates the sufficient conditions for gas pulsation generation: the existence of both pressure, difference and sudden opening. Because all PD fluid machines convert energy between shaft and fluid by dividing incoming continuous fluid flow into parcels of cavity size for delivery to discharge as indicated by its cycle, there is always a "sudden" opening at discharge to return these discrete parcels of cavity size back to a continuous stream again. So the two sufficient conditions are satisfied at the moment of discharge opening if there is a pressure difference existing between the cavity and outlet it is opened to. For compressors operating at off-design points with a fixed internal compression ratio, it is either an over-compression or under-compression as described previously. At design point, there will be no pressure difference induced pulsation according to the above Rule II. Since Roots type has no internal compression, it is always a case of under compression and is inherently generating gas pulsation. The pulsation magnitude predicted by Rule II can be very high if $(p_3-p_1)$ is large for an un-throttled (or infinitely fast) opening as in a shock tube. However, most PD type fluid machines operate with finite discharge opening speed which throttles the induced fluid flow to a maximum sonic velocity that takes place at a pressure ratio of 1.89. In addition, a suddenly moved hardware (like lobe, valve disk) induced flow pulsations co-exist with pressure difference induced pulsation, but its magnitude is typically much smaller for most industrial PD type fluid machinery. FIG. 2*b* shows graphically the above relationship between the initial unbalanced pressures and the amplitude of the resulting gas pulsations generated.

It should also be pointed out the drastic magnitude and behavior difference between acoustic waves and gas pulsations discussed above. First of all, the acoustics is limited to pressure fluctuations below level of 140 dB, equivalent to pressure 0.002 Bar or 0.03 psi. For industrial fluid machinery, the measured gas pulsations that are typically in range of 0.3-30 psi (or even higher), or equivalent to 160-200 dB. So gas pulsation pressures are much higher and well beyond the pressure range for acoustics. Physically, the acoustics are sound waves travelling at the speed of sound with no macro fluid movement with it while gas pulsations are a mixture of strong pressure and expansion waves travelling in opposite directions that also induce an equally strong macro fluid flow travelling unidirectionally with speeds from a few centimeters per second up to 1.89 times of the speed of sound (Mach Number=1.89). It is this large pressure difference and potentially huge force that could directly damage system and components on its travelling path, in addition to exciting vibrations and noises. With the above Gas Pulsation Rules, it is hoped that more realistic gas pulsation calculation is possible and the true nature of gas pulsations can be realized and fully appreciated.

Accordingly, it is always desirable to provide a new design and construction of a positive displacement compressor that is capable of achieving high gas pulsation and NVH reduction at source and improving compressor off-design efficiency without using a traditional serial pulsation dampener and a variable geometry while being kept light in mass, compact in size and suitable for high efficiency, variable pressure ratio applications at the same time.

SUMMARY OF THE INVENTION

Accordingly, it is an object of the present invention to provide a positive displacement compressor with a shunt pulsation trap in parallel with the compressor cavity for trapping and attenuating pulsations and the induced NVH close to pulsation source.

It is a further object of the present invention to provide a positive displacement compressor with a shunt pulsation trap in parallel with the compressor cavity that it is as efficient as a variable internal volume ratio design but with a much simpler structure and high reliability.

It is a further object of the present invention to provide a positive displacement compressor with a shunt pulsation trap in parallel with the compressor cavity that it is compact in size by eliminating the serially connected dampener at discharge.

It is a further object of the present invention to provide a positive displacement compressor with a shunt pulsation trap in parallel with the compressor cavity that is capable of achieving pulsation attenuation in a wide range of pressure ratios.

It is a further object of the present invention to provide a positive displacement compressor with a shunt pulsation trap in parallel with the compressor cavity that is capable of achieving higher pulsation attenuation in a wide range of speeds and cavity passing frequency.

It is a further object of the present invention to provide a positive displacement compressor with a shunt pulsation trap in parallel with the compressor cavity that is capable of achieving the same level of adiabatic efficiency in a wide range of pressure and speed without using a variable geometry.

BRIEF DESCRIPTION OF THE DRAWINGS

Referring particularly to the drawings for the purpose of illustration only and not limited for its alternative uses, there is illustrated.

DETAILED DESCRIPTION OF THE PREFERRED EMBODIMENT(S)

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1A:
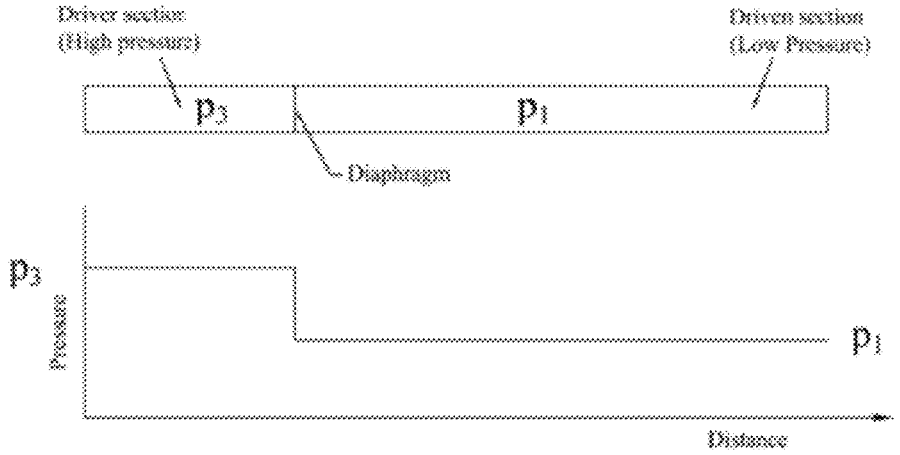
FIG. 1 shows a shock tube device and pressure and wave distribution before and after the diaphragm is broken.
Figure 1B:
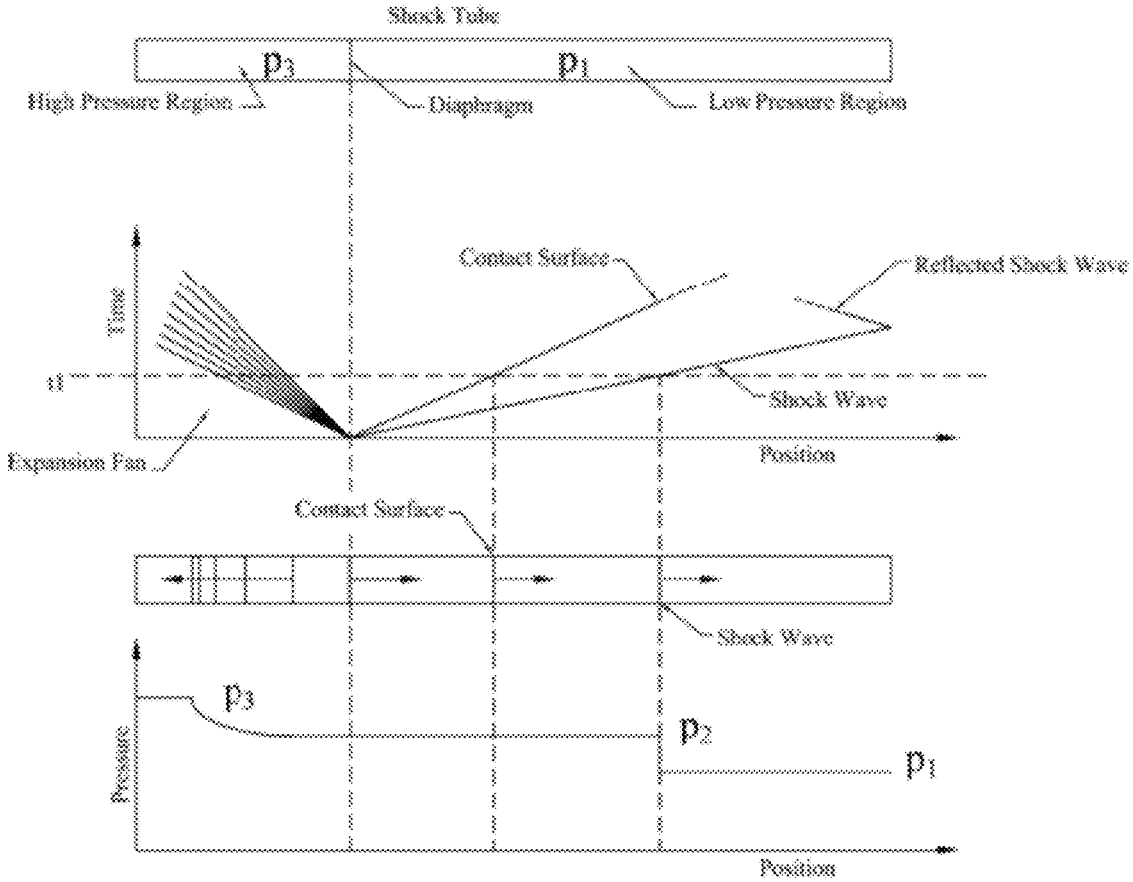
Figure 2A:
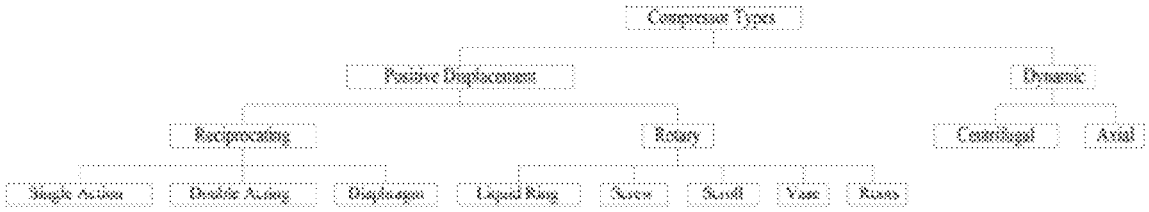
FIG. 2*a* shows a compressor classification chart for a sample of different types of positive displacement compressors covered under the present invention and FIG. 2*b* shows the amplitude of gas pulsation generation.
Figure 2B:
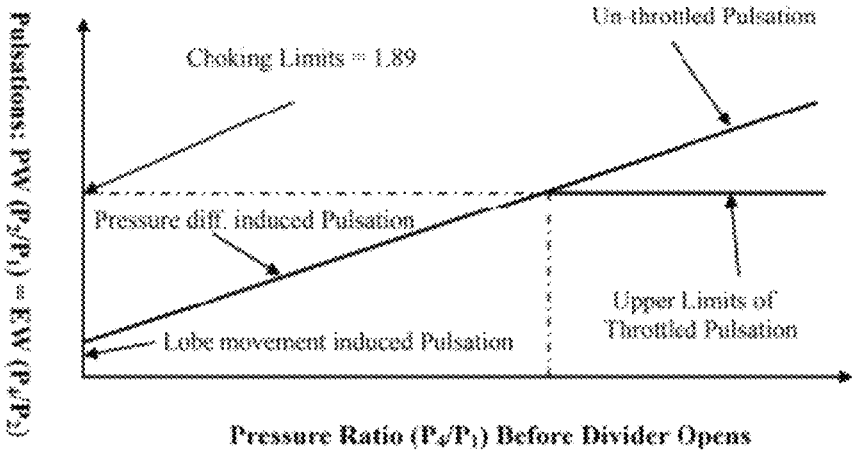

It should also be pointed out that though most drawing illustrations and description are devoted to a piston type gas compressor for controlling gas pulsations from under-compression mode in the present invention, the principle can be applied to other types of positive displacement compressors no matter it is a reciprocating or rotary as classified in FIG. 2*a*, because they all have the same pulsation control cycle—an essentially feedback control loop as shown in FIG. 4. The same is true for other media such as gas-liquid two phase flow as used in Air Conditioning or refrigeration. In addition, positive displacement expander is the above variation too except being used to generate shaft power from media pressure drop.

Figure 3A:
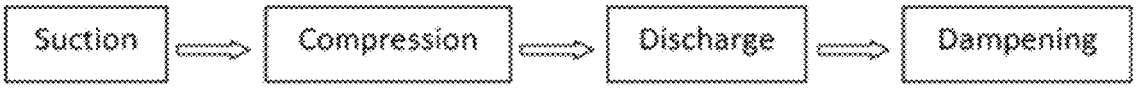
FIG. 3a (Prior Art)
FIGS. 3*a* and 3*b* show the compression cycle of a classical positive displacement compressor and FIGS. 3*c* and 3*d* show the trigger mechanism of pressure pulsation origination for an under-compression and over-compression when discharge valve is suddenly opened.
Figure 3B:
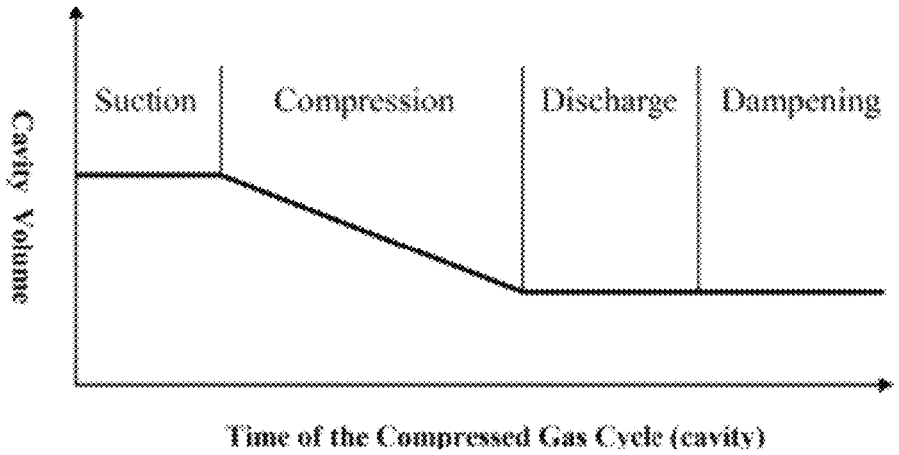
FIG. 3b (Prior Art)
Figures 3C, 3D:
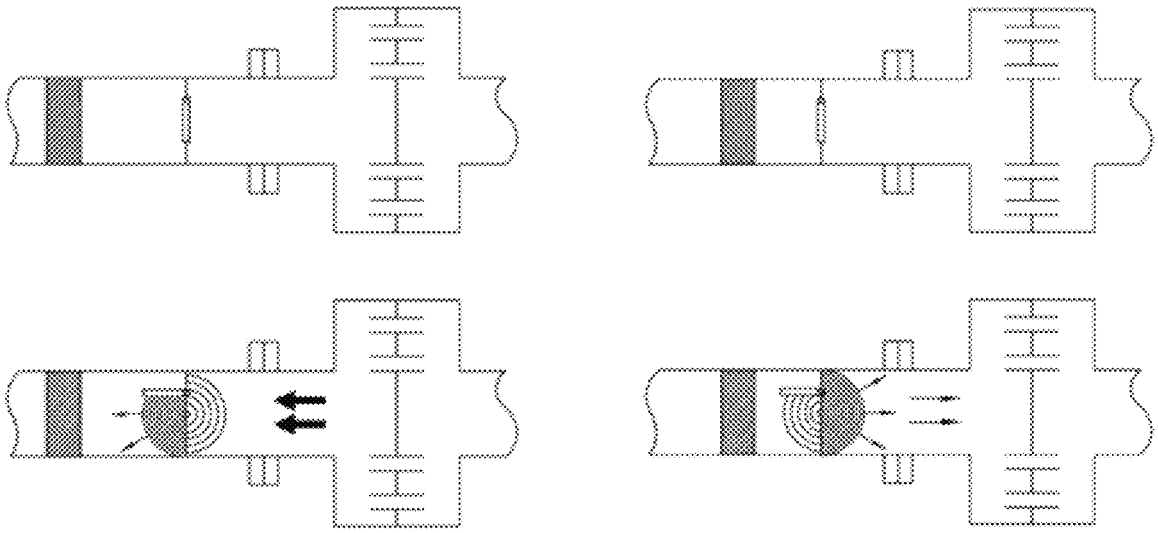
FIG. 3c-3d (Prior Art)
Figure 4A:
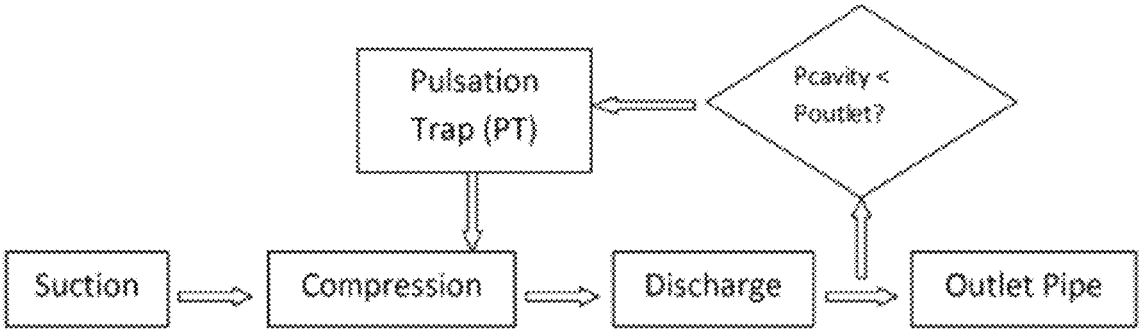
FIGS. 4*a* and 4*b* show different phases of the new compression cycle of a positive displacement compressor with a shunt pulsation trap, FIG. 4*c* reveals phase sequence of a under-compression in time domain
Figure 4B:
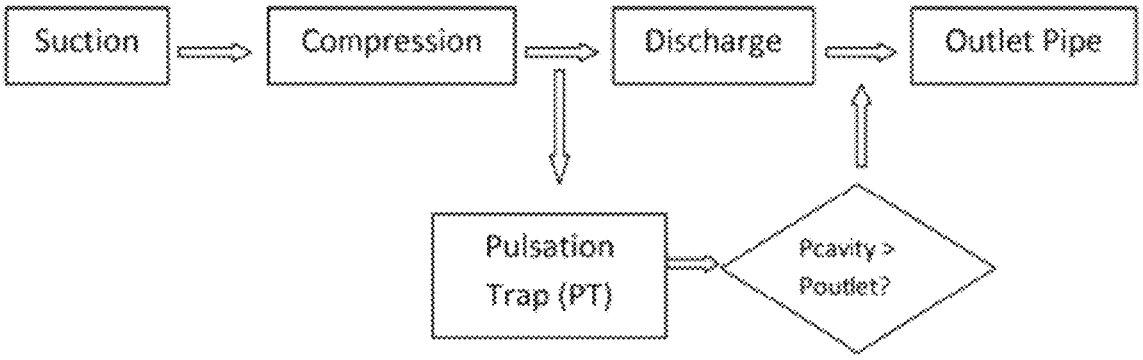
Figure 4C:
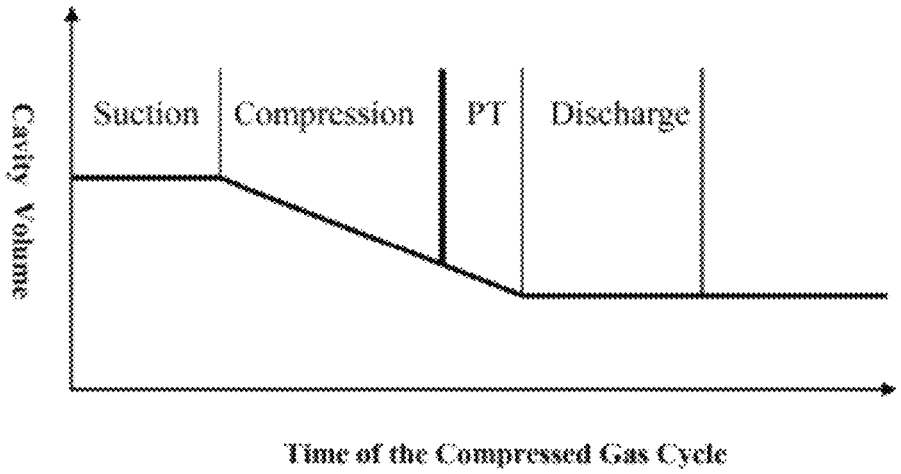
FIGS. 4*d* and 4*c* show the trigger mechanism of pressure pulsation origination for an under-compression and an over-compression when trap inlet is suddenly opened.
Figures 4D, 4E:
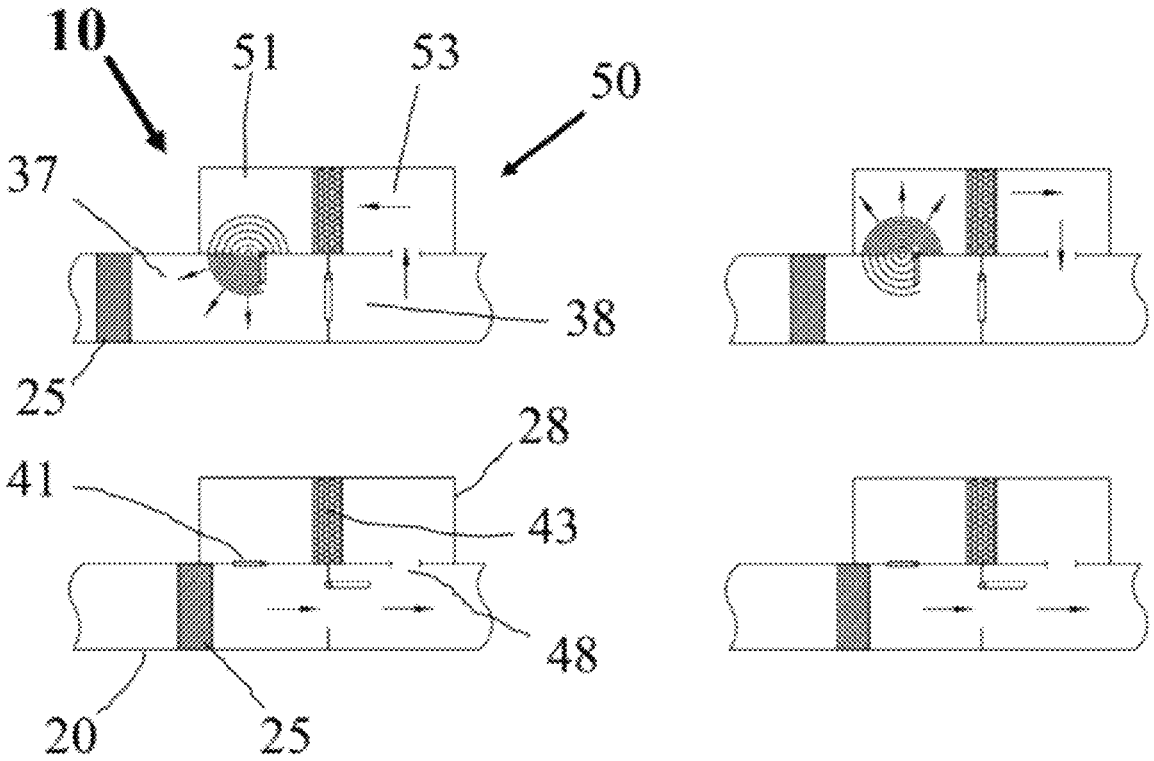

As a brief introduction to the principle of the present invention, FIGS. 4*a* to 4*b* show a new cycle of a positive displacement compression with the addition of a shunt (parallel) pulsation trap of the present invention just before compression phase finishes and well before discharge phase starts. In broad terms, pulsation traps are used to trap. AND to attenuate pulsations in order to reduce gas borne pulsations before discharging to downstream applications or releasing to atmosphere. Discharge dampener is one type of pulsation trap (traditional type) which is connected in series with and right after the compressor discharge port. The strategy is to filter out hence attenuate "pulsations" while let go with as little loss as possible "average flow". This is very difficult to achieve in reality simply because the unwanted "pulsations" are always mixed together with "average flow" and trying to control one will always harm the other. The shunt pulsation trap is another type of pulsation trap which is connected in parallel with the compressor cavity and well before the compressor discharge. As illustrated in FIGS. 4*a*-4*h*, the phases of flow suction and compression are still the same as those shown in FIGS. 3*a*-3*b* of a traditional cycle. But just before the compression phase finishes and discharge phase begins as in a conventional positive displacement compressor, a new pressure equalizing phase is added between the compression and discharge phases by subjecting the compressed flow cavity to a pre-opening port, called pulsation trap inlet, located just before the compressor discharge port and timed before the compression phase finishes as shown in FIG. 4. The trap inlet is branched off from the compressor cavity into a parallel chamber, called pulsation trap volume, which is also communicating with the compressor outlet through a feedback region called trap outlet located opposite to trap inlet, as shown in FIG. 4*d*-4*e*. Between the trap inlet and outlet, and within the trap volume, there exists one or more pulsation dampening devices to control (reduce, recover, and/or contain) pulsation energy before it travels to the compressor outlet. The strategy is to induce or separate out "pulsations" from "average flow" before it even reaches the discharge. After being separated, "pulsations" are trapped inside the trap chamber and being attenuated while "average flow" will stay inside the compressor cavity and waited to be discharged. As shown in top illustration of FIG. 4*d* at the moment when the compressor cavity is just opened to the trap inlet while still closed to the compressor discharge, a series of waves and flows are produced at trap inlet if there is a pressure difference between the pulsation trap (relates to compressor outlet pressure) and compressor cavity. For an under-compression, pressure waves or shock-wave are generated into the low pressure cavity increasing its pressure and inducing a back flow into the cavity at the same time, while on the other side, a simultaneously generated expansion waves travel into the high pressure trap and are being attenuated. Because waves travel at a speed about 5-20 times faster than the cavity driving piston or lobe speed, the pressure equalization inside the cavity or pulsation attenuation inside the trap volume are almost instantaneous, and finishes before the compressor cavity reaches the discharge. Therefore, as shown in the bottom illustration of FIG. 4*d* at the moment when the compressor cavity is opened to the compressor discharger the pressure inside the cavity is already equal to the outlet pressure, hence discharging a pressure-difference-free, or a pulsation-free gas flow. The same principle applies to an over-compression condition but with reversed wave patterns and induced flow as shown in FIG. 4*e*.

The principal difference with the conventional positive displacement compressor is in the discharge and dampening phase: instead of waiting and delaying the dampening action after the discharge by using a serially-connected dampener, the present invention shunt pulsation trap method would start dampening before the discharge by inducing pulsations into a paralleled trap. It then dampens the pulsations within the trap simultaneously as the compressor cavity travels to the outlet. In this process, the average main flow inside the compressor cavity and pulsations are separated and in parallel with each other so that attenuating the "bad" pulsations will not affect the efficiency of the main average flow.

There are several advantages associated with the parallel pulsation trap compared with the traditional serially connected dampener. First of all, pulsations are separated out from the main cavity flow so that an effective attenuation on pulsations will not affect the losses of the main cavity flow, resulting in both higher main flow efficiency and better pulsation attenuation effectiveness. In a traditional serially connected dampener, both pulsations and main fluid flow travel mixed together through the dampening elements where a better attenuation on pulsations always comes at a cost of higher flow losses or larger sizes. So a compromise is oven made in order to reduce flow losses by sacrificing the degree of pulsation dampening or having to use a very large volume dampener in a serial setup, increasing its size, weight and cost. Secondly, by pre-opening to discharge pressure, the compression mode is changed from internal volume ratio controlled compression to backflow compression, or shock wave compression according to the Shock Wave theory. So under-compression is always a preferred mode over an over-compression since the discharge system pressure will compensate whatever the additional pressure is required without wasting any energy from compressor driver. As shown in FIG. 4*c*, the degree of pre-opening depends on how wide of a range of the off-design so that an overall optimum efficiency is achieved. Thirdly, the parallel pulsation trap attenuates pulsation much closer to the pulsation source than a serial one and is capable of using a more effective pulsation dampening device (say a much higher dampening coefficient material) without affecting main flow efficiency. It can be built as an integral part of the casing as close as possible to the compressor cavity or in a conforming shape of the compressor cavity so that overall size and footprint of the compressor package is much smaller. By replacing the traditional serially connected dampener with a more compact parallel pulsation trap, the noise radiation and vibrating surfaces are much reduced too. Moreover, the pulsation trap casings can be made of a metal casting that will be more wave or noise absorptive, thicker and more rigid than a conventional sheet-metal dampener casing, thus further reduce noise and vibration.

Referring to FIG. 4*d*-4*e*, there is shown a typical arrangement of a preferred embodiment of a positive displacement compressor 10 with a shunt pulsation trap apparatus 50. Typically, a positive displacement compressor 10 has a suction port (not shown) and a gas trapping cavity 37 mated with a positive displacement drive device (a piston in this embodiment) 25 that compresses the trapped gas and discharge it to a discharge port 38 of the compressor 10. The positive displacement compressor 10 also has a compressor casing 20 that houses the compressor cavity 37 and the drive device 25, another adjacent casing 28, in between forming the pulsation trap chamber 51.

As an important novel and unique feature of the present invention, a shunt pulsation trap apparatus 50 is positioned parallel with the compressor cavity 37 of the positive displacement compressor 10 of the present invention, and its generic cross-section is illustrated in FIG. 4*d*. In the embodiment illustrated, the shunt pulsation trap apparatus 50 is farther comprised of an injection port (trap inlet) 41 branching off from the compressor cavity 37 into the pulsation trap chamber 51 and a feedback region (trap outlet) 48 connecting pulsation trap chamber 51 with compressor outlet 38, therein housed various pulsation dampening device 43. As trap inlet 41 is suddenly opened as shown in the top illustration in FIG. 4*d*, a series of pressure waves are generated at trap inlet 41 going into the compressor cavity 37 and a feedback flow 53 is induced at the same time. Simultaneously a series of expansion waves are generated at trap inlet 41, but travelling in a direction opposite to the feedback flow from trap inlet 41 going through dampener 43 before reaching trap outlet 48 and compressor outlet 38. The feedback flow 53 as indicated by the small arrows goes from the trap outlet 48 through the dampener 43 into the pulsation trap chamber 51 then converging to the trap inlet 41 and releasing into the compressor cavity 37. To improve the flow efficiency of the induced feedback flow 53 at the trap inlet 41, instead of a constant area orifice 61, an alternative converging cross-sectional shape 63 or a converging-diverging cross-sectional (De Laval nozzle) shape 65 as shown in FIG. 6*b* can be used in the feedback flow direction 53. In the bottom illustration of FIG. 4*d*, the small arrows show the direction of the main flow inside the cavity 37 when discharged to compressor outlet 38.

Figure 5:
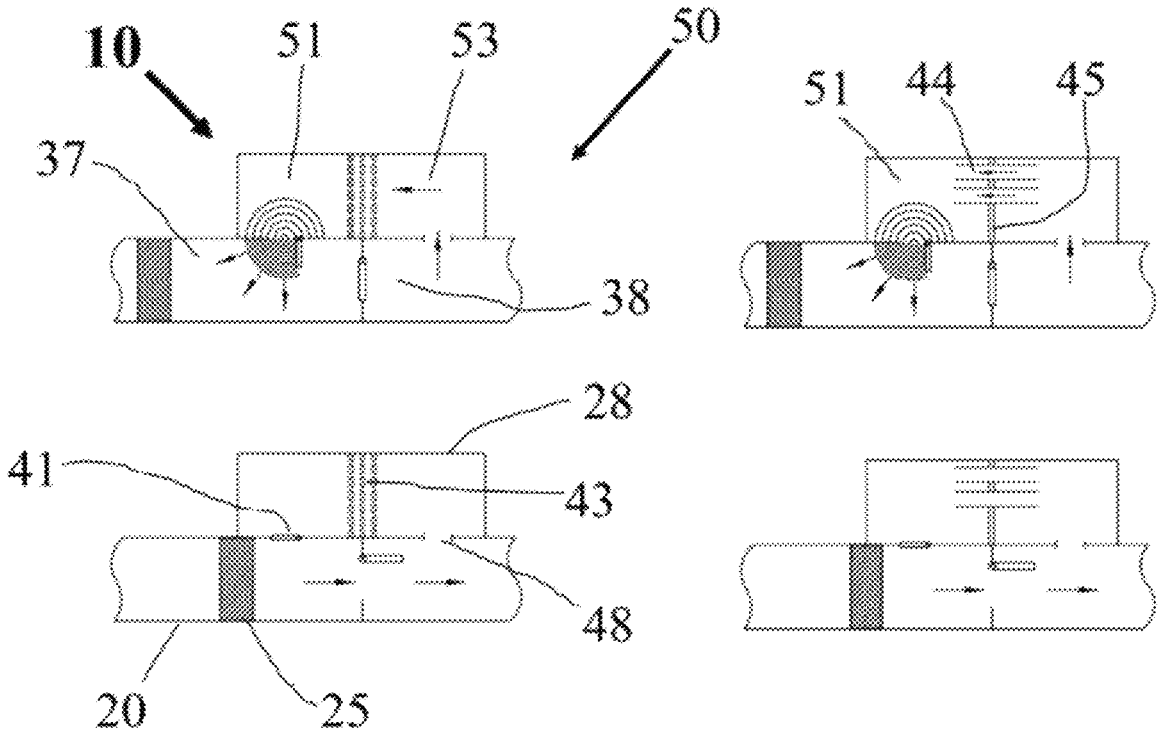
FIG. 5*a* shows a cross-sectional side view of a preferred embodiment of the shunt pulsation trap with some typical absorptive dampening devices and FIG. 5*b* with some typical reactive dampening devices.

When a positive displacement compressor 10 is equipped with the shunt pulsation trap apparatus 50 of the present invention, there exist both a reduction in the pulsation transmitted from positive displacement compressor to compressor downstream as well as an improvement in internal flow field (hence its adiabatic efficiency) for an under-compression case. The theory of operation underlying the shunt pulsation trap apparatus 50 of the present invention is as follows. As illustrated in FIG. 4*a* to 4*d* and also refer to FIG. 5, phases of flow suction, compression are still the same as those shown in FIGS. 3*a*-3*b* of a conventional positive displacement compressor. But just before compression phase finishes, instead of being opened to compressor outlet 38 as the conventional positive displacement compressor does, the compressed flow cavity 37 is pre-opened to the trap inlet 41 while the discharge port 38 is still closed. As shown in FIG. 4*d*, if there is no pressure difference between pulsation trap chamber 51 (close to pressure at outlet 38) and compressor cavity 37, then nothing happens even as two are connected. But if a pressure difference exists, a series of pressure waves or shock wave are generated into the cavity for the under-compression (or a series of expansion waves are generated into the cavity for the over-compression). The pressure waves traveling into compressor cavity 37 compress the trapped gas inside and at the same time, the accompanying expansion waves and a small portion of reflected, pressure waves or shock wave enter the pulsation trap chamber 51, and therein are being stopped and attenuated by pulsation dampening device 43. To improve pulsation absorbing rate, acoustical absorption materials or other similar types for turning pulsation into heat, can be used either inside pulsation trap chamber 51 or lining its interior walls (not shown). Because waves travel at a speed about 5-20 times faster than cavity driving piston or lobe speed, the compression and attenuation are almost instantaneously equalizing the pressure difference, hence discharging a pulsation-free gas media to compressor outlet 38. Therefore, the traditional serially connected outlet pulsation dampener is not needed anymore thus saving space and weight.

FIG. 5*a* shows a shunt pulsation trap with the dampening device including at least one layer of perforated plate 43. While pulsations are trapped by plate 43 inside the pulsation trap chamber 51 where it is being dampened, feedback flow 53 is still allowed to go through the pulsation trap 51 unidirectionally from trap outlet 48 to trap inlet 41 through the perforated plate 43 at high velocity. To reduce the feedback flow loss that is high for constant area shaped orifice holes 61 of a perforated plate, an alternative flow nozzle 63 or de Laval nozzle 65 can be used, as in FIGS. 6*b* and 6*c*, thus improving feedback flow efficiency compared to a traditional positive displacement device at under-compression conditions. FIG. 5*b* demonstrates another shunt pulsation trap with some typical reactive elements consisting of a combination of chokes 44 on a divider 45 inside trap volume 51 as dampening method. In theory, either one or more such dividers or at least one or more chokes can be used as a multistage or multichannel dampening.

Figure 6A:
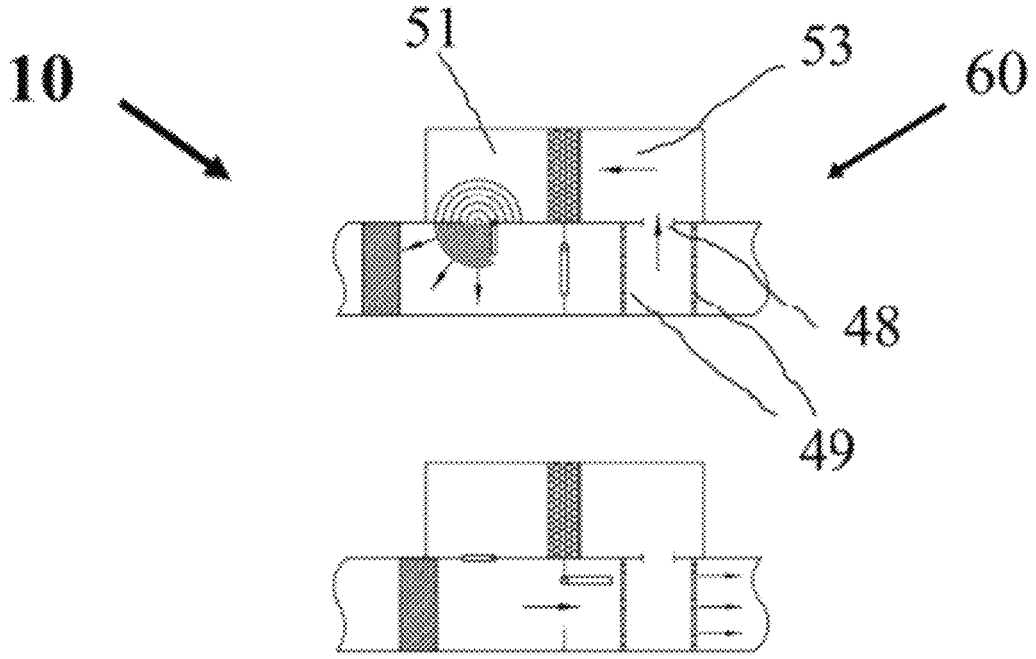
FIG. 6*a* shows cross-sectional side views of an alternative embodiment of the shunt pulsation trap with an additional wave reflector either before or after the trap outlet and FIG. 6*b* shows different hole shapes of a perforated plate of the shunt pulsation trap.
Figure 6B:
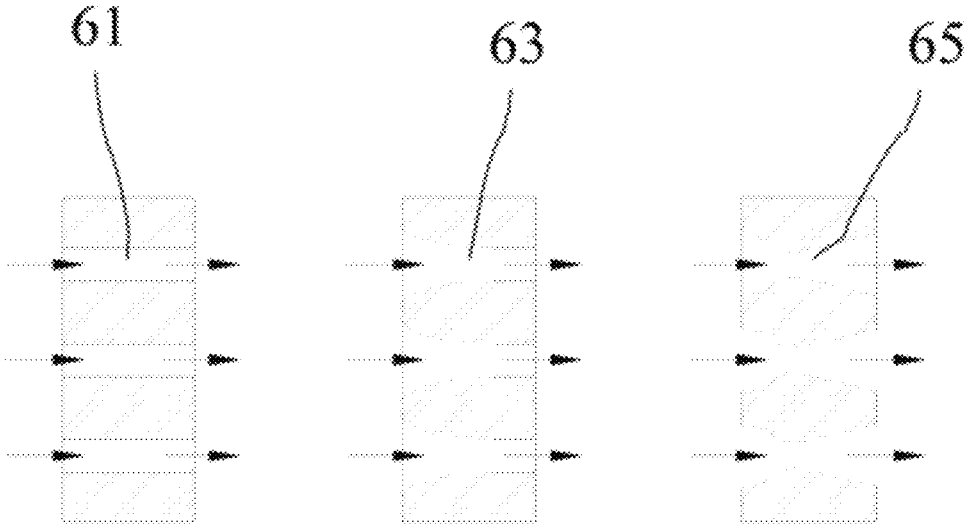

FIG. 6*a* shows a typical arrangement of an alternative embodiment of the positive displacement device 10 with a shunt pulsation trap apparatus 60. In this embodiment, a perforated plate 49 acting as both a wave reflection and a dampener is added to the pulsation trap 60. The wave reflector 49 can be located either before or after the trap outlet 48. In theory, a wave reflector is a device that would reflect waves while let fluid go through without too much losses. In this embodiment, the leftover residual pulsations either from the compression cavity 37 or coming out of pulsation trap outlet 48 or both could be further contained and prevented from traveling downstream causing vibrations and noises, thus capable of achieving more reductions in pulsation and noise but with additional cost of the perforated plate and some associated losses. If the reflector 49 is positioned between trap outlet 48 and compressor outlet 38, the feedback flow 53 will go through the pulsation trap 51 while the main discharge flow is unidirectionally going through the discharge wave reflector 49 as shown in FIG. 6*a* without flow reversing losses, and the associated losses are greatly reduced too by using perforated holes with shape of either a flow nozzle 63 or de Laval nozzle 65 as shown in FIG. 6*b*, thus improving flow efficiency at discharge compared to a traditional positive displacement device.

Figure 7:
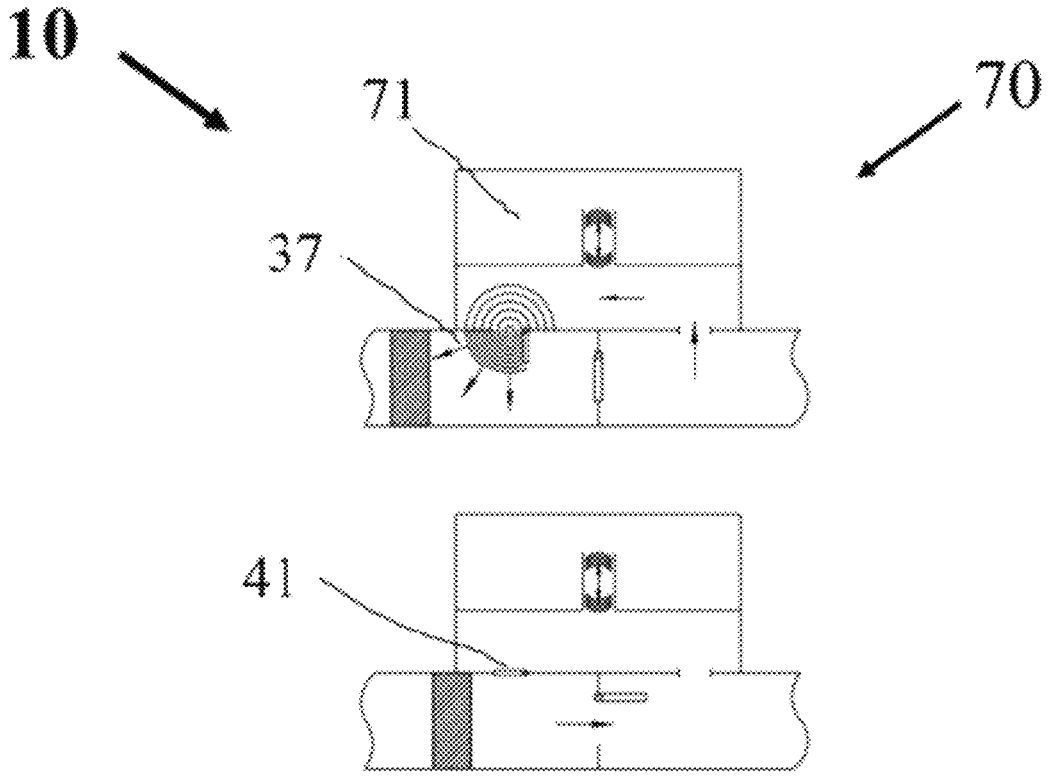
FIG. 7 shows a cross-sectional side view of an alternative preferred embodiment of the shunt pulsation trap with a Helmholtz resonator.

FIG. 7 shows a typical arrangement of yet another alternative embodiment of the positive displacement compressor 10 with a shunt pulsation trap apparatus 70. In this embodiment, Helmholtz resonator 71 is used as an alternative pulsation dampening device. In theory, Helmholtz resonator could reduce specific undesirable frequency pulsations by tuning to that problem frequency thereby eliminating it. Since the positive displacement compressor generates a specific pocket passing frequency when running at fixed speed and Helmholtz resonator could be tuned to that specific frequency for elimination. In this embodiment, the pulsations generated at trap inlet 41 would be treated by Helmholtz resonator 71 located close to trap inlet 41. It can be used alone or in series with absorptive damper, and numbers can be one or multiple of different sizes.

Figure 8:
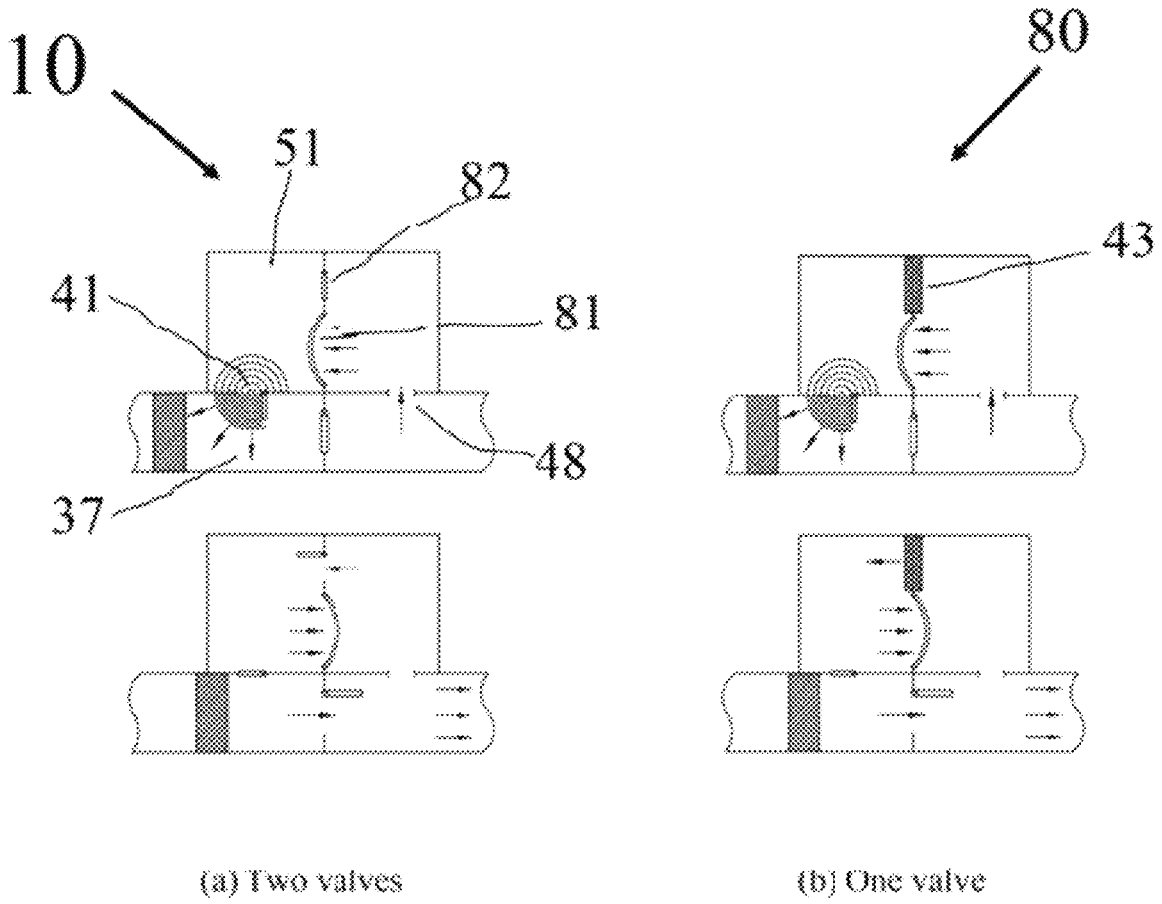
FIG. 8 shows cross-sectional side views of another alternative embodiment of the shunt pulsation trap with a diaphragm as a dampener device and pump.
Figure 9:
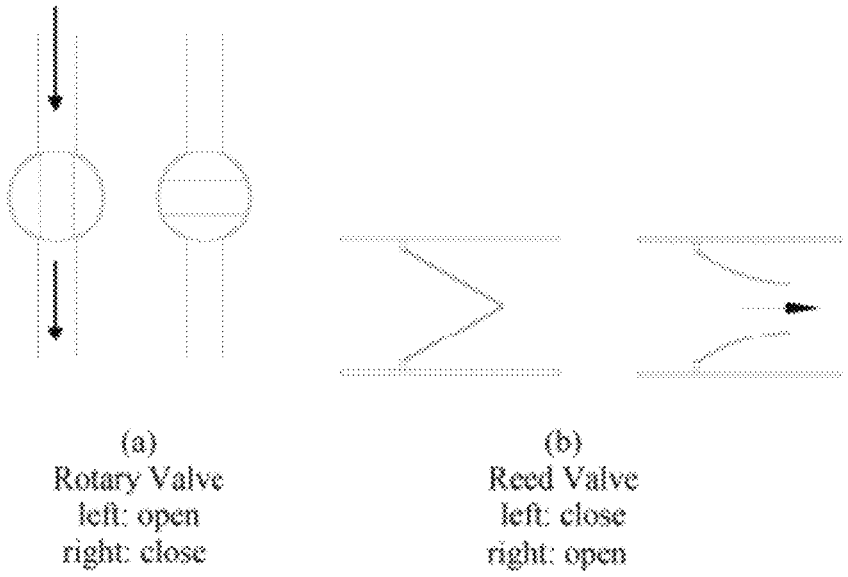
FIGS. 9*a* and 9*b* show a cross-sectional view of a rotary valve and a reed valve in open and close positions.

FIGS. 8 show some typical arrangements of yet another alternative embodiment of the positive displacement compressor 10 with a shunt pulsation trap apparatus 80. In this embodiment, a diaphragm 81 is used as an alternative pulsation dampening device, for energy recovery purposes. FIG. 8*a* shows a two-valve configuration and FIG. 8*b* a one-valve configuration with a perforated-plate dampener device in place of the valve. In FIG. 8*a*, the top view shows a charging (dampening) phase with only the trap inlet 41 open to the compressor cavity 37 while the trap outlet 48 and valve 82 are closed. In the same way, the bottom view shows a discharging (pumping) phase with the trap inlet 41 closed to the compressor cavity 37 while the trap outlet 48 and valve 82 open. The valve 82 used could be any types that are capable of being controlled and timed in the fashion as described above, and one example is given in FIG. 9 for a rotary valve and a reed valve. In operation, as an example shown in FIG. 8*a* again for under-compression, a series of waves are generated as soon as the pulsation trap inlet 41 is open to cavity 37 during charging phase. The pressure waves would travel into the compressor cavity 37 while the accompanying expansion waves enter the pulsation trap chamber 51 in opposite direction. Because of the pressure difference between the pulsation trap chamber 51 (close to outlet pressure) and compressor cavity 37, the diaphragm 81 would be pulled towards the trap inlet 41 by the pressure difference hence absorbing the pulsation energy and storing it with the deformed diaphragm 81 (charged). At this time, the valve 82 is closed, effectively scaling the waves within the pulsation trap chamber 51. As the pressure difference is diminishing and cavity 37 is opened to the outlet 38 as shown in the bottom view of FIG. 8*a*, the diaphragm 81 would be pulled away from the trap inlet 41 by the stored energy, resulting in a pumping action sucking gas in from the now opened valve 82, building up the pressure again in the pulsation trap chamber 51 while trap inlet 41 is kept closed at this time. By alternatively open and close valves 41 and 82 in a synchronized way, the pulsation energy could be effectively absorbed and re-used to keep the cycle going while pulsations within the trap is kept contained and attenuated, resulting in a pulse-free discharge flow with minimal energy losses.

Figure 10:
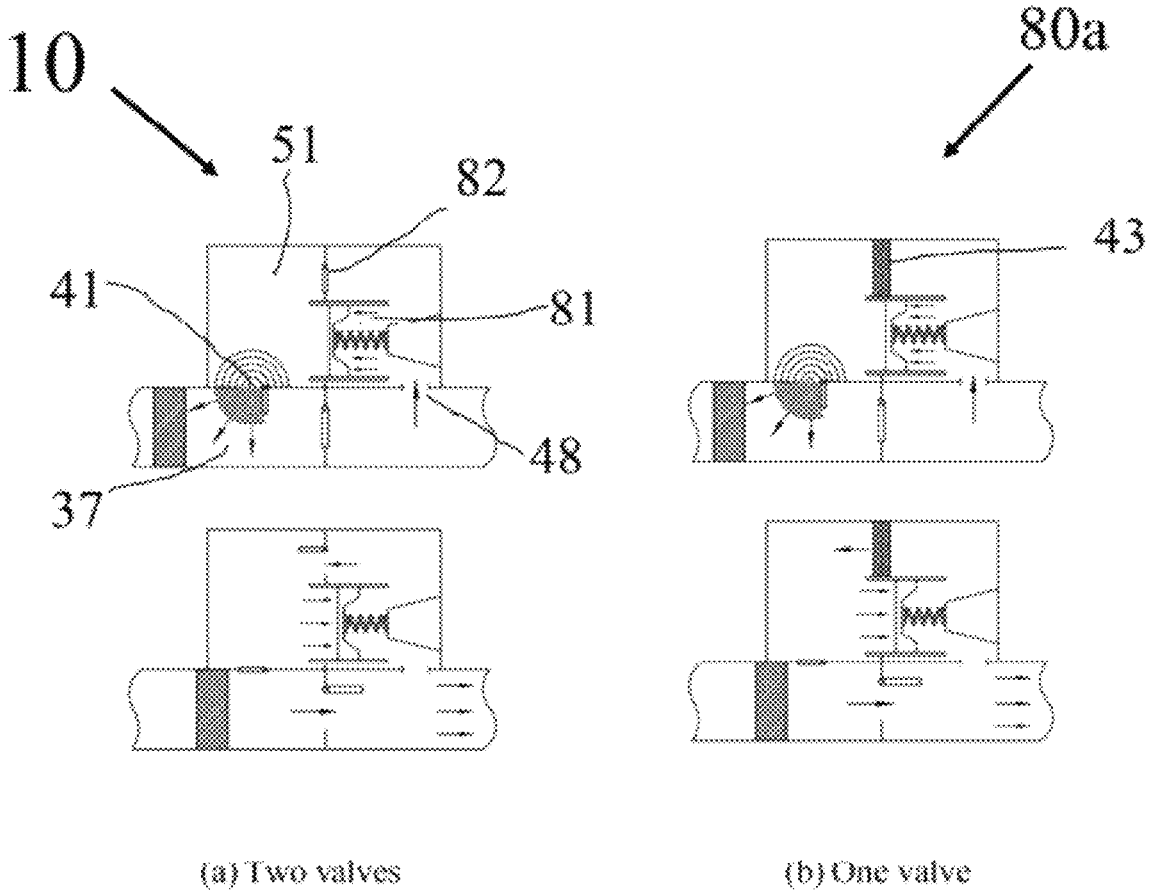
FIG. 10 shows cross-sectional side views of another alternative embodiment of the shunt pulsation trap with a piston as a dampener device and pump.

FIG. 10 is similar to FIG. 8 except using a piston instead of a diaphragm.

Figure 11:
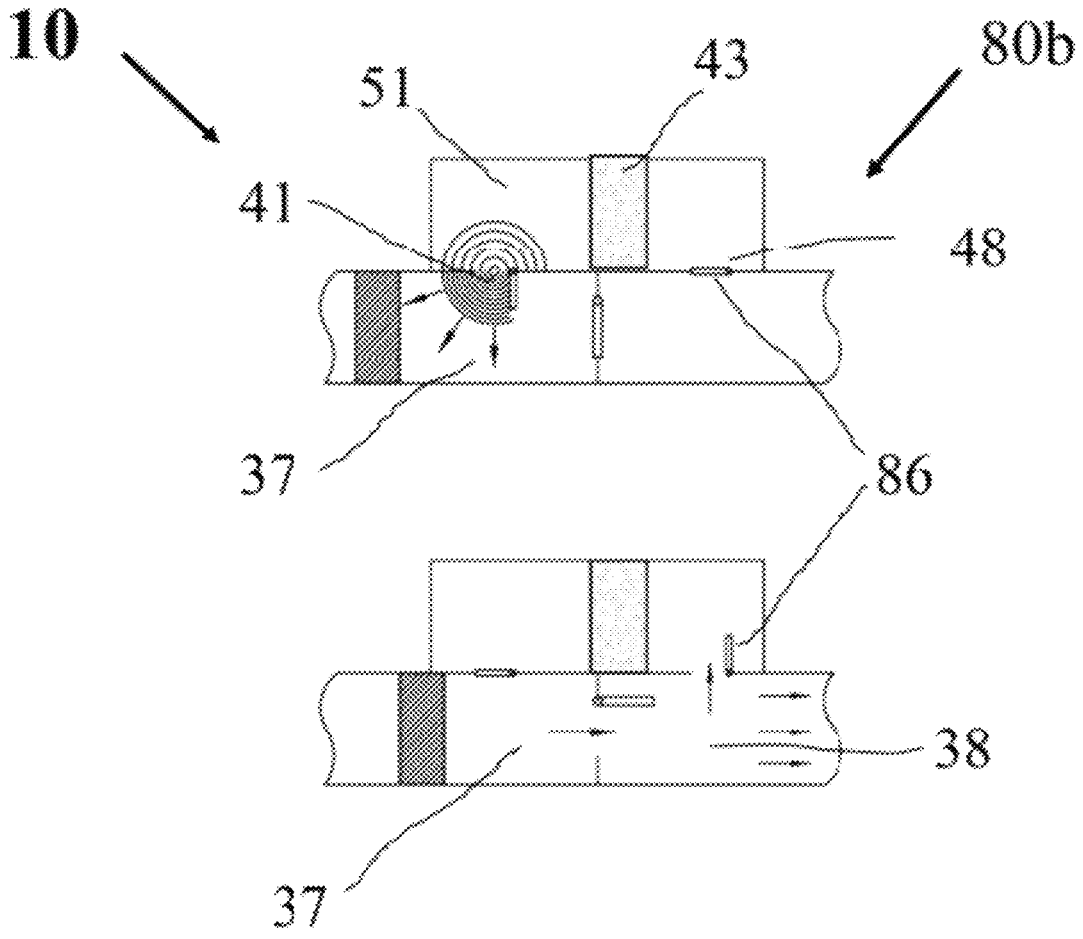
FIG. 11 shows cross-sectional side views of yet another alternative embodiment of the shunt pulsation trap with a valve at trap outlet.

FIG. 11 shows a typical arrangement of yet another alternative embodiment of the positive displacement compressor 10 with a shunt pulsation trap apparatus 80*b*. In this embodiment, a control valve 86 is used as pulsation dampening device, for energy containment purposes, at trap outlet 48. In addition, FIG. 11 shows a configuration with an optional dampener 43 between trap inlet 41 and control valve 86.

The principle of operation is taking advantages of the opposite travelling direction of waves and flow inside the pulsation trap 80*b* in an under-compression. By using a directional controlled valve 86, it would only allow flow in while keeping the waves from going out of the trap in a timed fashion. The top view of FIG. 11 shows the wave containment phase with the trap inlet 41 open to the compression cavity 37 while the trap outlet 48 is closed by the valve 86. In the same way, the bottom view of FIG. 11 shows a flow-in phase when the compression is finished and the trap outlet 48 is opened through the valve 86. The valve 86 used could be any types that are capable of being flow controlled like a reed valve or timed with trap inlet opening in a fashion as described above, and one example is given in FIG. 9*a* for a rotary valve. In operation, as an example shown in FIG. 11 again for under-compression, a series of waves are generated as soon as the pulsation trap inlet 41 is opened during the containment phase. The pressure waves would travel into the cavity 37 while the accompanying expansion waves enter the pulsation trap chamber 51 in opposite direction. At this time, the valve 86 located at the trap outlet 48 is closed, effectively sealing the pulsations within the pulsation trap chamber 51 where it is being dampened by an optional pulsation dampener device 43 inside. After the pressure difference is diminishing and cavity 37 is opened to outlet 38 as shown in the bottom view of FIG. 11, the valve 86 at trap outlet 48 is opened allowing gas into the trap and building up the pressure again in the pulsation trap chamber 51. By alternatively open and close valve 86 in a synchronized way timed with the trap inlet opening the waves and pulsation energy could be effectively contained within the trap, resulting in a pulse-free gas flow to the outlet.

It is apparent that there has been provided in accordance with the present invention a positive displacement compressor with a shunt pulsation trap for effectively reducing the high pulsations caused by under-compression or over-compression without increasing overall size of the compressor. While the present invention has been described in context of the specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A positive displacement compressor, comprising:

a. a housing structure having a flow suction port, a flow discharge port, and a compressor cavity;

b. a positive displacement drive device mounted inside said compressor cavity and driven in a compression phase to reduce said compressor cavity volume and propel flow from said suction port to said discharge port;

c. a shunt pulsation trap apparatus comprising a trap chamber positioned adjacent to said compressor cavity, at least one pulsation dampening device positioned within said trap chamber, at least one trap inlet branching off from said compressor cavity into said pulsation trap chamber, and at least one trap outlet communicating with said compressor discharge port;

d. wherein in operation said positive-displacement compressor is capable of achieving high gas pulsation and NVH reduction close to source and improving compressor off-design efficiency without using a serial pulsation dampener.

2. The positive displacement compressor as claimed in claim 1, wherein said trap inlet is sealed from said compressor suction port and is located before said discharge port.

3. The positive displacement compressor as claimed in claim 2, wherein said trap inlet has a converging cross-sectional shape or a converging diverging cross-sectional shape in a feedback flow direction.

4. The positive displacement compressor as claimed in claim 1, wherein said pulsation dampening device comprises at least one layer of perforated plate.

5. The positive displacement compressor as claimed in claim 1, wherein said pulsation dampening device comprises at least one divider plate with chokes inside said trap volume.

6. The positive displacement compressor as claimed in claim 1, wherein said pulsation dampening device comprises at least one layer of perforated plate on which there is at least one synchronized valve that is timed to close or open as said trap inlet is opened or closed.

7. The positive displacement compressor as claimed in claim 1, wherein said pulsation dampening device comprises at least one Helmholtz resonator.

8. The positive displacement compressor as claimed in claim 1, wherein said pulsation dampening device comprises at least one Helmholtz resonator in parallel with at least one layer of perforated plate.

9. The positive displacement compressor as claimed in claim 1, wherein said pulsation dampening device comprises at least one Helmholtz resonator in parallel with at least one synchronized valve that is timed to close or open as said trap inlet is opened or closed.

10. The positive displacement compressor as claimed in claim 1, wherein said pulsation dampening device comprises at least a diaphragm or a piston in parallel with at least one layer of perforated plate for energy recovery for partially absorbing pulsation energy and turning that energy into pumping gas from said trap outlet through said perforated plate into said trap.

11. The positive displacement compressor as claimed in claim 1, wherein said pulsation dampening device comprises at least a diaphragm or a piston in parallel with an opening for energy recovery for absorbing pulsation energy and turning that energy into pumping gas from said trap outlet through said opening into said trap.

12. The positive displacement compressor as claimed in claim 1, wherein said pulsation dampening device comprises at least a diaphragm or a piston synchronized with at least one valve for energy recovery for absorbing pulsation energy and turning that energy into pumping gas from said trap outlet through said valve into said trap.

13. The positive displacement compressor as claimed in claim 1, wherein said pulsation trap further comprises at least one perforated plate located at said discharge port before, after, or both before and after said trap outlet.

14. The positive displacement compressor as claimed in claim 1, wherein said pulsation dampening device comprises at least one control valve located at said trap outlet for energy containment.

15. The positive displacement compressor as claimed in claim 1, wherein said pulsation dampening device comprises at least one layer of perforated plate or acoustical absorption materials for turning pulsation into heat, in series with at least one control valve located at said trap outlet for energy containment.

16. The positive displacement compressor as claimed in claim 6, wherein said synchronized valve in said pulsation dampening device is a one way valve, a reed valve, or a rotary valve, that is timed to close or open as said trap inlet is opened or closed.

17. The positive displacement compressor as claimed in claim 12, wherein the at least one valve is a rotary type, a reed valve type, or a combination of a rotary valve and a reed valve.

18. The positive displacement compressor as claimed in claim 4, wherein said perforated plate has holes with a cross-sectional shape of either a constant area, a converging shape, or a converging-diverging shape in a feedback flow direction.

19. The positive displacement compressor as claimed in claim 13, wherein said perforated plate has holes with a cross-sectional shape of either a constant area, a converging shape, or a converging-diverging shape in a discharge flow direction.

20. the positive displacement compressor, wherein said perforated plate as claimed in claim 1, wherein said pulsation dampening device comprises at least one layer of acoustical absorption materials for turning pulsation into heat, either inside said pulsation trap chamber or lining its interior walls.

* * * * *